United States Patent [19]

Kawamura

[11] Patent Number: 4,580,118

[45] Date of Patent: Apr. 1, 1986

[54] SUPERCONDUCTING COIL

[75] Inventor: Toshimi Kawamura, Suita, Japan

[73] Assignee: Mitsubishi Denki Kabushiki Kaisha, Tokyo, Japan

[21] Appl. No.: 700,898

[22] Filed: Feb. 12, 1985

[30] Foreign Application Priority Data

Feb. 24, 1984 [JP] Japan ..... 59-32534

[51] Int. Cl.[4] ..... H01F 7/22

[52] U.S. Cl. ..... 335/216; 174/126 S; 336/DIG. 1

[58] Field of Search ..... 335/216, 299; 174/126 S; 336/DIG. 1

[56] References Cited

U.S. PATENT DOCUMENTS 3,129,359 4/1964 Kunzler ..... 335/216 X 3,283,277 11/1966 Hulm et al. ..... 335/216

*Primary Examiner*—George Harris

*Attorney, Agent, or Firm*—Leydig, Voit & Mayer, Ltd.

[57] ABSTRACT

The superconducting coil comprises a high magnetic field inner section and a low magnetic field outer section disposed around the inner section. Both the inner and outer sections are forcedly cooled and extend over the entire axial length of the superconducting coil. The inner section for the high magnetic field has a layer-winding structure while the outer section for the low magnetic field has a pancake-winding structure.

3 Claims, 5 Drawing Figures

SUPERCONDUCTING COIL

BACKGROUND OF THE INVENTION

This invention relates to a superconducting coil and more particularly to a graded superconducting coil having high and low magnetic field sections.

A graded superconducting coil has a high magnetic field section and a low magnetic field section. The high magnetic field section is a section of the superconducting coil formed with a high magnetic field conductor material such as $Nb_3Sn$.

The conventional arrangements of these sections are schematically illustrated in cross-section in FIGS. 1 to 3. FIG. 1 shows a superconducting coil 10 in which a ring-shaped high magnetic field section 12 is surrounded at its outer circumference and axial end faces by a low magnetic field section 14. FIG. 2 shows another superconducting coil 20 in which a tubular high magnetic field section 22 extending from one axial end of the superconducting coil to the other axial end is surrounded at its outer circumference by a low magnetic field section 24 having the same length as the inner high magnetic field section 22. FIG. 3 illustrates a third type of superconducting coil in which a ring-shaped high magnetic field coil 32 is sandwiched in the axial direction between two similar ring-shaped low magnetic field sections 34.

In the superconducting coil 10 shown in FIG. 1, the coil conductors in the high magnetic field section 12 and the coil conductors in the low magnetic field section 14 must be joined at a great number of locations. On the other hand, since the superconducting conductors of different materials must be joined by an ordinary conductor material such as solder, the number of connections in the coil conductors must made as small as possible. Therefore, the coil section arrangement 10 shown in FIG. 1 is not suitable for a superconducting coil.

Coil 20 shown in FIG. 2 has a layer-winding structure, and a coil 30 shown in FIG. 3 has a pancake-winding structure. Coils 20 and 30 shown in FIGS. 2 and 3 are suitable since the number of conductor joints in the superconducting coil is greatly reduced as compared to the arrangement shown in FIG. 1.

However, when the coils are to be forcedly cooled by supercritical helium, the coolant helium is caused to flow through parallel passages in order to minimize pressure loss as shown in FIG. 4, in which a pair of laminated conductor ends 40 are connected by a pair of rigid connectors 42. The connectors 42 are connected to each other by brazing or soldering, and the other ends of the connectors 42 are electrically connected to conductor ends 40 by brazing or soldering or swaging. Each coil conductor 40 is surrounded by an independent jacket 44 having a port 46. Therefore the inlet and outlet of the coolant helium are provided in the vicinity of the end portion of the coolant jacket 44. The inlet and outlet for the helium as well as the junctions of the coil conductors should be positioned at the coil end or on the coil outer circumference in order to provide easy access thereto.

However, with the coil section arrangement shown in FIG. 2 having a layer-winding structure, the inner and the outer coil sections 22 and 24 have different average length per turn. Therefore, the helium pressure-loss is different for the inner and outer coil sections, generating a pressure imbalance in the parallel-supplied coolant helium, making the design of the cooling system difficult. Also, designing the superconducting coil to be free from the above cooling problem makes the superconducting coil decreases the degree of freedom which inevitably increases the overall dimensions of the superconducting coil.

With the coil 30 of FIG. 3 in which a pancake winding is used shown in FIG. 3, the problem of the helium pressure imbalance posed in the arrangement shown in FIG. 2 can be easily reduced. However, this arrangement requires a relatively large amount of the expensive high magnetic field material.

SUMMARY OF THE INVENTION

Accordingly, an object of the present invention is to provide a superconducting coil free from the above explained drawbacks of the conventional design.

Another object of the present invention is to provide a superconducting coil in which the expensive coil conductor material for the high magnetic field section is relatively small in quantity, the coil conductor junctions can be positioned outside of the coil, and in which the helium coolant pressure loss is minimized.

With the above objects in view, the superconducting coil of the present invention comprises a high magnetic field inner section and a low magnetic field outer section disposed around the inner section. Both the inner and outer sections extend over the entire axial length of the superconducting coil. The inner section for the high magnetic field has a layer-winding structure while the outer section for the low magnetic field has a pancake-winding structure.

BRIEF DESCRIPTION OF THE DRAWINGS

The present invention will become more readily apparent from the following detailed description of the preferred embodiment of the invention taken in conjunction with the accompanying drawings, in which.

DESCRIPTION OF THE PREFERRED EMBODIMENT

Figure 1:
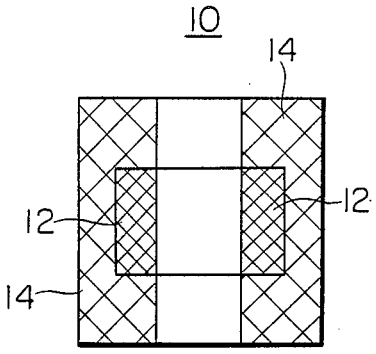
FIG. 1 PRIOR ART
FIG. 1 is a schematic sectional view of a conventional superconducting coil.
Figure 2:
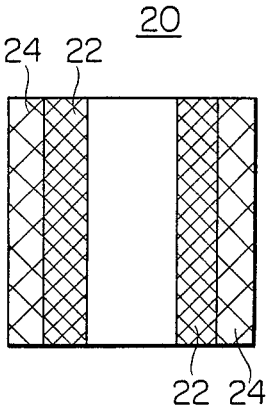
FIG. 2 PRIOR ART
FIG. 2 is a schematic sectional view of another conventional superconducting coil having a layer-winding structure.
Figure 3:
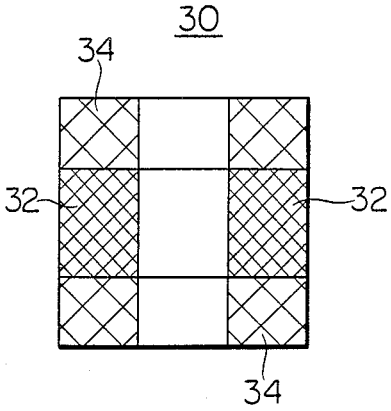
FIG. 3 PRIOR ART
FIG. 3 is a schematic sectional view of a still another conventional superconducting coil having a pancake-winding structure.
Figure 4:
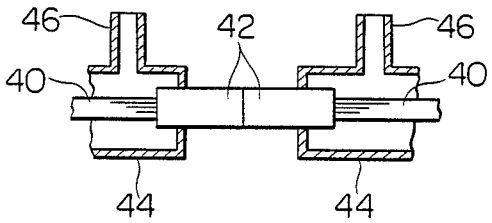
FIG. 4 is a fragmental sectional view of the junction of the coil conductors to which helium coolant jackets are applied.
Figure 5:
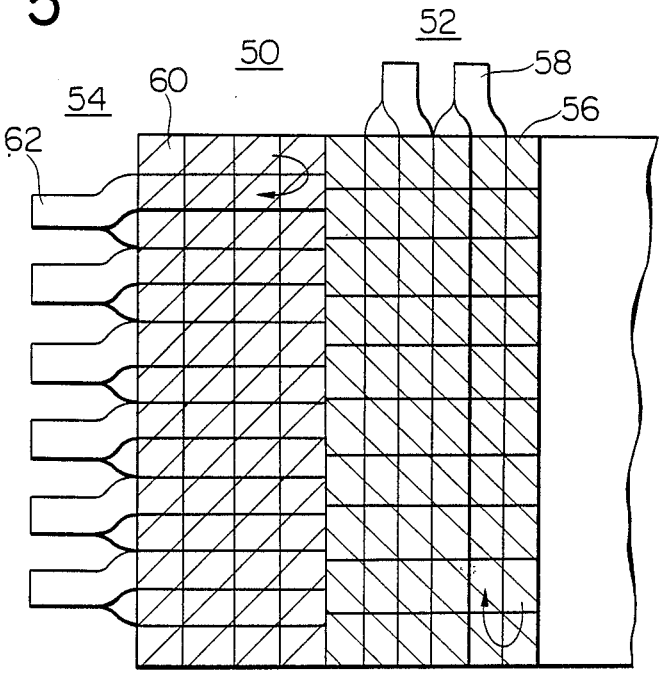
FIG. 5 is a schematic sectional view of the superconducting coil of the present invenion.

In FIG. 5, in which one embodiment of a superconducting coil of the present invention is schematically illustrated in a fragmental sectional view, it is seen that a superconducting coil 50 of the present invention comprises a high magnetic field inner section 52 and a low magnetic field outer section 54 disposed around the inner section, and the inner and outer sections 52 and 54 extend over the entire axial length of the superconducting coil 50. The inner section 52 has a layer-winding structure having a plurality of coil layers 56, one of which is schematically shown by a solid line. As seen from FIG. 5, the coil layers 56 extend in the axial direction of the superconducting coil 50 from one coil end to the other coil end, and each one is provided with a connector assembly 58 similar to that illustrated in FIG. 4 at one of the coil ends. The outer section 54 has a pancake-winding structure including a plurality of pancake coils 60, one of which is shown by a solid line. The pancake coils 60 extend in the radial direcion with respect to the superconducting coil 50. Each of the pancake coils 60 has a connector assembly 62 similar to that illustrated in FIG. 4.

Since the superconducting coil of the present invention is constructed as above described, the connector assemblies 58 between the layer-wound coil sections 56 in the high magnetic field inner section 52 are positioned on the coil end, and no junction is formed inside of the coil section. Also, the connector assemblies 62 between the pancake coil sections 60 of the low magnetic field outer section 54 are positioned on the outer circumference of the superconducting coil 50 and there is no inside coil conductor junction. Therefore, connecting the coil conductors by brazing or the like is easy and the connection of the helium port 46 to the exterior helium supply (not shown) can also be easily made. Further, the helium pressure imbalance is lessened because of the equal pressure loss in the pancake coils 62.

What is claimed is:

1. A superconducting coil comprising a high magnetic field inner section and a low magnetic field outer section disposed around said inner section, said inner and outer sections extending over the entire axial length of the superconducting coil, said inner section having a layer winding structure while said outer section has a pancake winding structure.

2. A superconducting coil as claimed in claim 1, wherein said superconducting coil is if a forced-cooling type.

3. A superconducting coil as claimed in claim 1, wherein said inner section has a plurality of layer-wound coil sections electrically connected to each other by a connector positioned at an axial end portion of said coil sections, and said outer section has a plurality of pancake coil sections electrically connected to each other by a connector assembly positioned at an outer radial end.

* * * * *